United States Patent [19]

Chierici et al.

[11] 4,120,404

[45] Oct. 17, 1978

[54] COUPLER SHANK BEARING ARRANGEMENT FOR SUPPORTING RAILROAD CAR COUPLERS ON COUPLER CARRIERS

[75] Inventors: Osvaldo F. Chierici, Elmhurst; Richard F. Murphy, Aurora, both of Ill.

[73] Assignee: Holland Company, Lombard, Ill.

[21] Appl. No.: 838,162

[22] Filed: Sep. 30, 1977

[51] Int. Cl.[2] ..... B61G 7/10

[52] U.S. Cl. ..... 213/61; 213/21; 213/60; 213/62 R

[58] Field of Search ..... 213/7, 8, 10, 12, 14, 213/20, 21, 50, 51, 54, 60, 61, 65, 62 R, 62 A, 67 R, 67 A, 69; 308/DIG. 8, DIG. 9

[56] References Cited

U.S. PATENT DOCUMENTS

| | | | |
|---|---|---|---|
| 2,944,831 | 7/1960 | Thomas | 308/DIG. 8 |
| 3,240,354 | 3/1966 | Williams | 213/21 |
| 3,402,826 | 9/1968 | Clejar et al. | 213/61 X |
| 4,055,254 | 10/1977 | Chierici et al. | 213/51 X |

*Primary Examiner*—Trygve M. Blix
*Assistant Examiner*—Sherman D. Basinger
*Attorney, Agent, or Firm*—McWilliams & Mann

[57] ABSTRACT

This invention relates to a coupler shank bearing arrangement for supporting a railroad car coupler on its coupler carrier, and more specifically, to a railroad car coupler support arrangement in which the familiar coupler wear plate that rides on the coupler carrier is replaced by a bearing arrangement of the plane bearing type that provides for essentially wear free support of the coupler on its carrier. The coupler shank lower wall is formed with an elongate mounting slot at the location of application of the conventional wear plate, and extending longitudinally of the coupler shank, to which slot is applied a one piece bearing structure formed from an ultra high molecular weight polymer of dry self lubricating characteristics. The bearing structure is in the form of a one piece body shaped to define a lower generally planar bearing plate portion and an upper mounting portion in the form of an elongate ridge structure especially shaped for bond free but secure application to the coupler shank mounting slot.

11 Claims, 5 Drawing Figures

COUPLER SHANK BEARING ARRANGEMENT FOR SUPPORTING RAILROAD CAR COUPLERS ON COUPLER CARRIERS

This invention relates to a coupler shank bearing arrangement for supporting a railroad car coupler on its coupler carrier, and more specifically, to a railroad car coupler support arrangement in which the familiar coupler wear plate that rides on the coupler carrier is replaced by a bearing arrangement of the plane bearing type that provides for essentially wear free support of the coupler on its carrier.

The familiar type E and F coupler applications call for the coupler shank to be equipped on its underside with a hardened steel wear plate that rides on the coupler carrier, which in turn is supported by the car center sill, usually by being mounted on the striker casting. The wear plate in question is secured to the coupler shank by being welded in place. The coupler wear plate in question is by its nature a wear away item that requires periodic replacement even under the best of circumstances.

Coupler wear plates have long been a problem in the railroad field. When the wear plate is to be replaced, welding is required to mount the replacement wear plate in place, and this means that the coupler shank must be heat treated to relieve stresses induced by the welding involved; failure to follow appropriate heat treatment procedures on replacing the coupler wear plate can lead to failure of the coupler in service.

Furthermore, the familiar welded-on coupler wear plate presents additional difficulties that are quite apart from its wear away nature. For instance, the welds that secure the wear plate in place on the coupler shank are subject to breakage from several different causes. For instance, during transit, movement of the car over the track frequently subjects the coupler to severe vibration that all too frequently fractures the welds in question.

Also, weld breakage can be traced to buff and impact stresses applied to the coupler during service. The Applicant's studies of this phenomenon have indicated to him that one reason for this is that coupler shanks tend to flex under the impetus of buff and draft impacts acting on the coupler, and the wear plate welds to the coupler shank do not flex with the coupler shank, resulting in their fracture and eventual loss of the wear plate from the car.

In any event, it is common knowledge in the railroad field that coupler wear plate repair and replacement work requires all too frequent shopping of the car with consequent expense and loss of revenue while the car is shopped, with the risk that the heat treating procedures required for the coupler shank after the re-welding that has been done to replace or repair the coupler wear plate will be inadvertently omitted.

A principal object of the invention is to provide a coupler shank bearing arrangement that provides for replacement of the familiar metallic wear away type coupler wear plate with an essentially wear free plain bearing structure that does not require bonding to the coupler shank as such to secure the bearing structure to the coupler, that mounts the coupler shank for free sliding movement on its coupler carrier, and that flexes with the coupler shank under the impetus of buff and draft impacts while resisting dislodgement due to these forces as well as the severe vibration that couplers can be subject to in service.

Another principal object of the invention is to provide a coupler shank and bearing support arrangement for railroad car coupler applications that under ordinary circumstances will have a useful life expectancy equivalent to that of the car.

Yet another principal object of the invention is to provide a coupler shank bearing arrangement for supporting the coupler shank on the familiar coupler carrier that eliminates the need for welding or other procedures to bond the bearing structure to the coupler shank at the location of the familiar wear plate, using instead a simple hammer-in-place application procedure.

Still other objects of the invention are to provide a coupler shank bearing arrangement that is economical of manufacture, convenient to install and use, and long lived in operation.

In accordance with the invention, there is provided a coupler shank bearing arrangement for supporting the coupler on the conventional coupler carrier, as a result of which the conventional welded-in-place metallic wear plate is entirely eliminated, together with the welding and coupler shank heat treatment procedures heretofore required. Instead, the coupler shank lower wall is formed with an elongate mounting slot at the location of application of the conventional wear plate, and extending longitudinally of the coupler shank, to which slot is applied a one piece bearing structure formed from an ultra high molecular weight polymer of dry self lubricating characteristics. The bearing structure is in the form of a one piece body shaped to define a lower generally planar bearing plate portion and an upper mounting portion in the form of an elongate ridge structure especially shaped for bond free but secure application to the coupler shank mounting slot. The bearing ridge structure defines a base section integral with the bearing plate portion and a head section projecting normally of and away from the bearing plate portion and having a crest extending longitudinally of and substantially paralleling the bearing ridge structure. The bearing ridge structure between the crest and the base section of the bearing body defines along either side of same an apex portion extending along either side of the bearing ridge structure and adjacent the bearing top section crest, and projecting to either side of the bearing ridge structure at approximately equal levels above the bearing plate portion.

The bearing body ridge structure is shaped to define a deep slot extending longitudinally of same along its mid portion and opening at the ridge structure crest and having a depth down to approximately the bearing ridge structure base section. The bearing ridge structure slot divides the bearing ridge structure into a plurality of parallel mounting walls that extend longitudinally of the bearing ridge structure.

Further in accordance with the invention, the coupler shank lower wall is formed to define a slot extending longitudinally of the coupler shank, with the coupler shank on the inside surfacing of the shank lower plate defining an inwardly directed lip on either side of the slot. The bearing body ridge structure and coupler shank slot are proportioned for force fitting of the bearing body ridge structure into and through the coupler shank slot by a simple hammering action on the bearing plate portion, with the parts being arranged so that while the bearing can flex with the coupler shank under the impetus of buff and draft impacts applied to the coupler, it resists dislodgement and disconnection from the coupler shank, even against severe vibration that couplers are frequently subject to in service.

The bearing structure bearing plate portion on its underside defines a slide surface that is characterized by effecting resurfacing of the coupler carrier that provides not only for freedom of movement of the coupler shank in following the sidewise and longitudinal movements of the coupler, but also makes the coupler carrier surfacing contacted by same effectively resistant against wear without being subject to any appreciable wear itself.

Other objects, uses and advantages will be obvious or become apparent from a consideration of the following detailed description and the application drawings in which like reference numerals indicate like parts throughout the several views.

However, it is to be distinctly understood that the specific drawing illustrations provided are supplied primarily to comply with the requirements of the Patent Laws, and the invention is susceptible of other embodiments that will be obvious to those skilled in the art, and that are intended to be covered by the appended claims.

Figure 1:
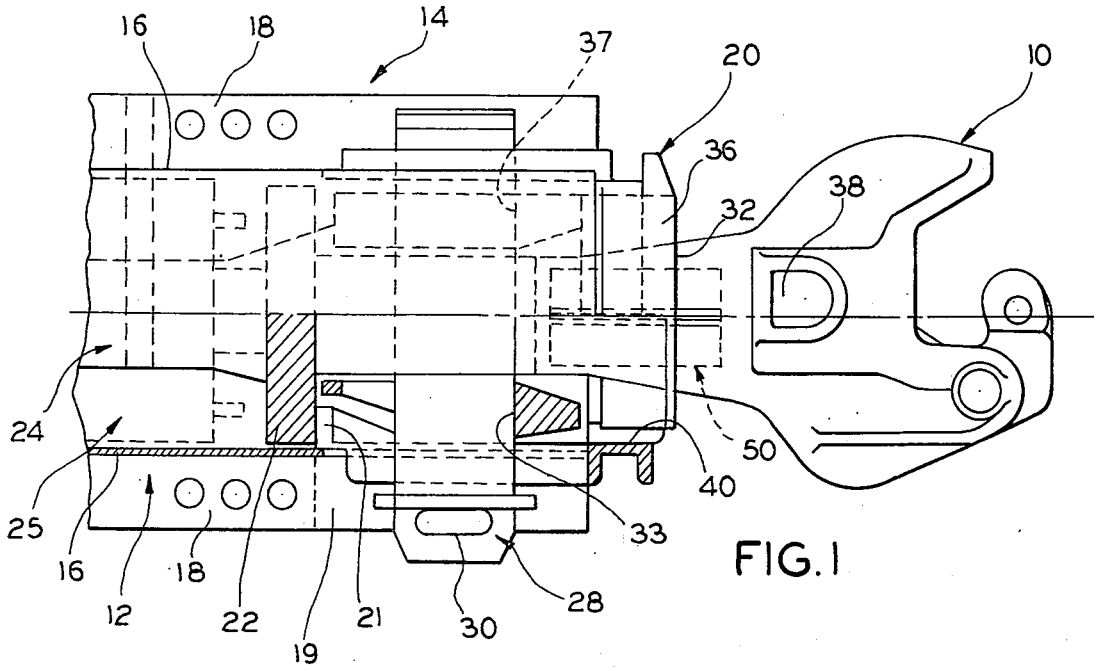
FIG. 1 is a fragmental plan view of one end of a railroad car center sill having a type E coupler applied thereto, showing the coupler and striker casting, partially broken away to show or indicate other specific parts of the assembly involved.
Figure 2:
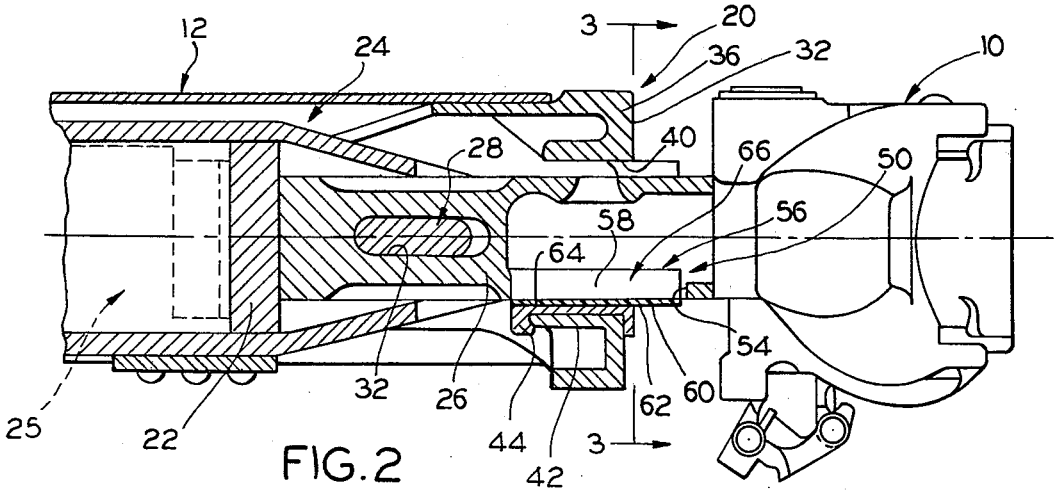
FIG. 2 is a vertical sectional view of the arrangement shown in FIG. 1, better showing the coupler carrier and one embodiment of the coupler shank bearing arrangement of this invention.
Figure 3:
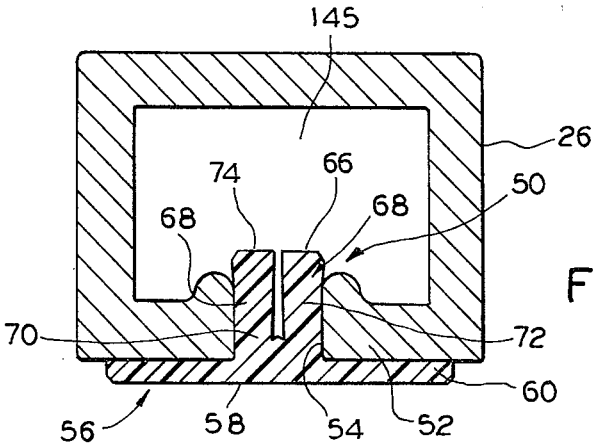
FIG. 3 is a diagrammatic sectional view through the coupler shank and bearing arrangement therefor, taken on an enlarged scale.

Reference numeral 10 of FIGS. 1 and 2 generally indicates an AAR type E coupler applied to conventional center sill 12 that is an integral part of railroad car body 14 (the latter being largely omitted except for the relevant parts in the area of the operating location of the coupler 10).

The center sill 12 is of the usual inverted channel shaped type, defining spaced side walls 16 each having a laterally directed edge flange 18. Suitably fixed to the terminal end portion of end sill 12 is conventional striker casting 20 that includes forward draft gear stop lugs 21 (see FIG. 1) against which is seated the usual front follower 22 that is operably associated with the usual conventional draft gear 25 that has its other end seated against the usual rear stop lugs that are not shown. The draft gear 25 (which is shown only diagrammatically as its specifics have nothing to do with the present invention), and its front follower 22 are embraced, as is conventional, by vertical yoke 24 that is connected to the shank 26 of the coupler 10 by draft key 28 that is held in place by the usual draft key retainer 30. As usual for type E couplers, the coupler shank 26 is slotted transversely of same as at 32 to receive the key 28 and the yoke 24 defines the usual draft key receiving openings 33.

The striker casting 20 comprises the usual vertically disposed striker portion 36 having the familiar planar striking face 32 which is adapted to be engaged by the usual horn 38 of the coupler. Striker portion 36 is of generally planar configuration and defines an open center or window 40 through which the coupler shank 26 extends for connection to the yoke 24 and thus to center sill through draft gear 25.

In the type E application shown in the drawings, the striker casting 20 defines a floor wall or ledge 42 on which is mounted the familiar coupler carrier iron 44 that is commonly employed for type E coupler applications. Conventionally, the coupler shank 26 has welded to its underside 52 the familiar metallic wear plate (not shown) which rests on the coupler carrier 44.

In accordance with the present invention, the car is equipped with the coupler shank bearing arrangement indicated at 50, which replaces and eliminates the conventional wear plate and provides the means whereby the coupler shank 26 is supported on the coupler carrier 44.

Following the principles of the invention, the lower wall 52 of the coupler shank is formed to define elongate mounting slot or opening 54, and operatively mounted in the mounting opening or slot 54 is bearing structure 56 that is of special one piece construction and composition.

Bearing structure 56 comprises a body 58 that is formed in one piece configuration from ultra high molecular weight (UHMW) polyethylene having a molecular weight in the range of from about 3 to about 9 million. In the preferred embodiment, the body 58 is formed from the molecularly oriented UHMW polyethylene marketed by Ketrol Enterprises of York, Pa. under the trademark TUFLAR (grade PL).

The material specified is a high density polymer of dry self lubricating characteristics that is sufficiently compaction resistant to resist any substantial compaction under compressive forces up to its elastic limit, and that has a high degree of elastic memory for full return to original free standing shape after being stressed, up to its elastic limit. This material also has a high degree of toughness and long wearing characteristics, and is also receptive to fillers in the form of glass, clay, sand, suitable fabrics, and alumina for modifying same to adapt the body 58 for special conditions.

The body 58 is shaped to define a lower generally planar bearing plate portion 60 defining a planar slide surface 62 that rides on the coupler carrier 44 and specifically its slide surface 64. Body 58 also defines an upper mounting portion 66 upstanding from the bearing plate portion 60, with the mounting portion being in the form of an elongate ridge structure 68 defining a base section 70 that is integral with the body bearing plate portion 60 and a head section 72 having a crest 74. As indicated in FIG. 2, the bearing body plate portion 60 and mounting portion 66 extend the length of the body 58, with the ridge structure 66 being disposed along the mid portion of the body 58 and the crest 74 extending longitudinally of and being coterminous with the mounting portion 66. Body plate portion 60 includes bevelled side edge surfaces 75 along either side of slide surface 62.

Figure 4:
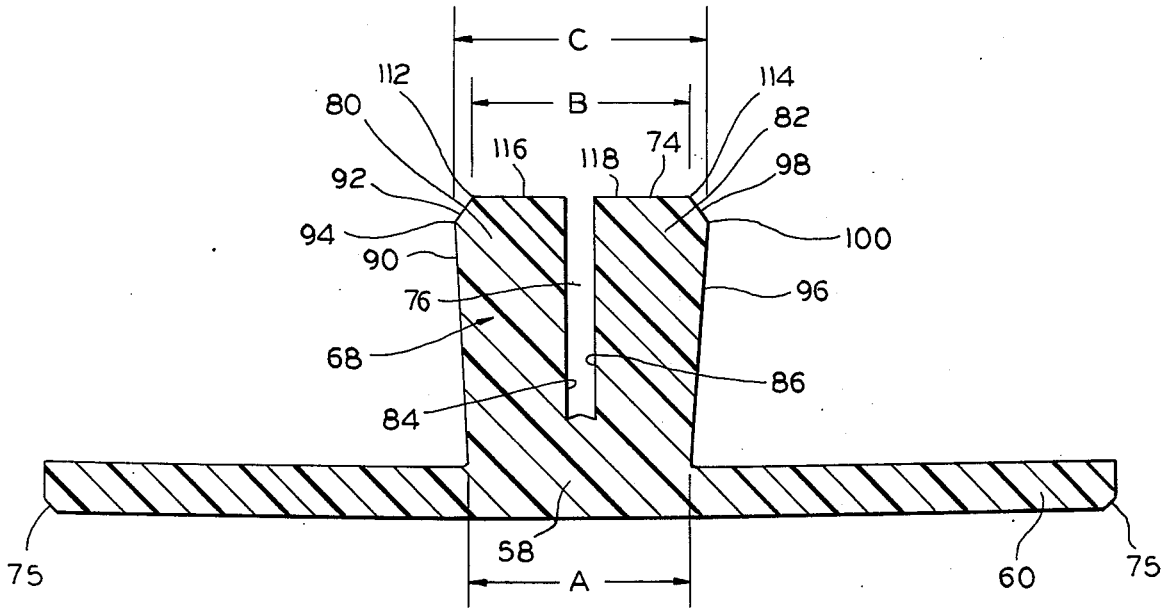
FIG. 4 is a diagrammatic transverse sectional view through the bearing structure per se, taken on still a larger scale.

The ridge structure 68 is formed to define in the unstressed, free standing, configuration of the body 58 the special configuration indicated at FIG. 4, including slot 76 that extends longitudinally of the body 58 and from the crest 74 of mounting portion 66 to adjacent the mounting portion base section 70. As indicated in FIG. 4, the slot 76 is of equal breadth or width along the length of the body 58 and for the depth of the slot 76 into the bearing body mounting portion 66.

Slot 76 defines the body ridge structure 68 into a pair of spaced parallel mounting walls 80 and 82 that extend longitudinally of and are coterminous with the length of the body mounting portion 66.

In accordance with the invention, there is a special relationship between the shaping of the coupler shank slot 54, the adjacent portion of the coupler shank floor 52, and the surfacing of the body mounting portion 66.

Referring to the showing of FIG. 4, it will be noted that in the unstressed, free standing relation of the body 50, the surfaces 84 and 86 defined by the slot 76 are in parallelism for the depth of the slot 76. The surfaces 84 and 86 also extend parallel to the body mounting portion 66 and transversely of the plane of the body bearing plate portion 60.

However, the outwardly facing side surfaces of the walls 80 and 82 are of apex configuration, they defining on the wall 80 wide side surface 90 and narrow edge or bevel surface 92 that merge adjacent the level of the crest 74 at apex portion 94. Similarly, the wall 82 has wide side surface 96 and narrow edge or bevel surface 98 that merge to define apex portion 100. The apex portions 94 and 100 and the respective wall surfaces defining same extend longitudinally of and coterminous with the length of the body 58, with the apex portions 94 and 100 being at identical or substantially identical levels above the plane of the bearing plate portion 60 and below the level of the crest 74.

Figure 5:
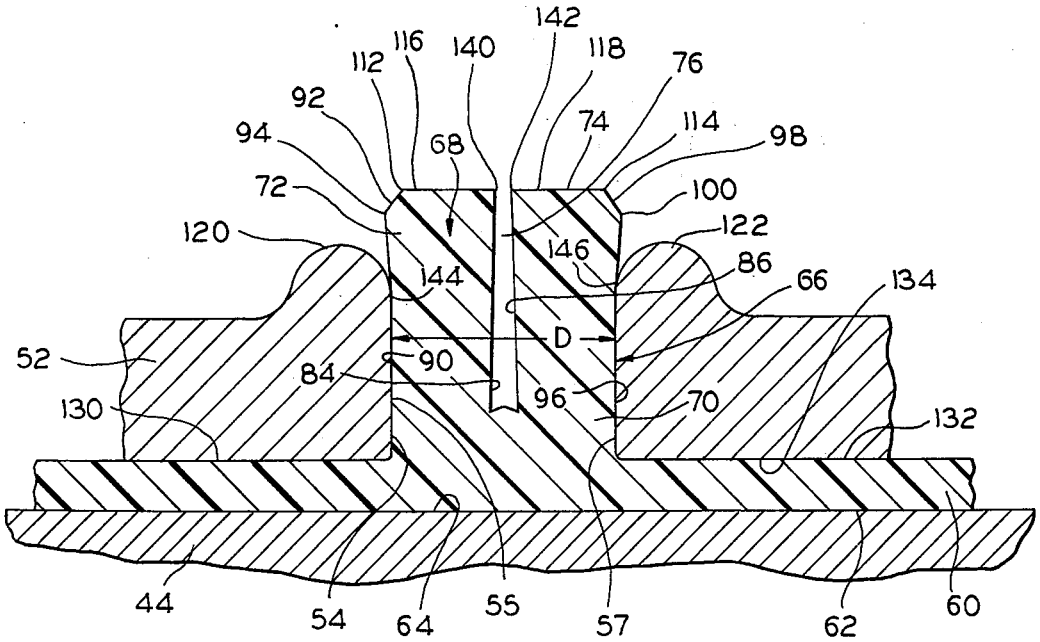
FIG. 5 is a view similar to FIG. 3, but fragmental in nature and on a larger scale, better illustrating the relationship between the body of bearing material involved and the adjacent coupler shank parts.

Further in accordance with the invention, the base section 70 of the body 58 at its juncture with the bearing plate portion 60 has a dimension transversely of the body 58 (the dimension A of FIG. 4) that substantially complements the corresponding dimension or width of the coupler shank slot 54 (the dimension D of FIG. 5).

Further in accordance with the invention, the crest 74 of the body 58, which extends longitudinally of the body 58 and transversely thereof between the body corners 112 and 114 that are defined by the surfaces 92 and 98 and the top surfaces 116 and 118 of the walls 80 and 82 has a dimension transversely of the body 58 (the dimension B of FIG. 4) in the unstressed relation of the body 58 that is less than the dimension D, while the apex portions 94 and 100 are separated or spaced apart transversely of the body 58 by dimension transversely of the body 58 (dimension C of FIG. 4) that exceeds that of the corresponding dimension of the slot 54 (dimension D of FIG. 5).

In addition, the lower wall 52 of the coupler shank, on either side of its slot 54, is formed to define the upstanding convexly rounded lips 120 and 122 that parallel the slot 54.

In practicing the invention, the slot 54 and lips 120 and 122 are formed as part of the casting operation for the coupler 10, and specifically its shank 26. The body 58 is formed by practicing suitable molding or extrusion procedures employing the polymer material specified. Bodies 58 are preferably proportioned lengthwise thereof to extend substantially the full length of the coupler shank slot 54.

In applying the body 58 to the coupler shank slot 26, which is done before the coupler is applied to the car, the coupler shank is positioned to expose the slot 54, after which a body 58 is selected and disposed to present the crest 74 of the body mounting portion 66 to and within the coupler shank slot 54. Using a hammer of suitable size and weight, the worker can then strike the slide surface 62 that forms the underside of bearing plate portion 60 to force the body mounting portion 66 into and through the coupler shank slot 54, to the position indicated in FIG. 5, wherein the upper surfaces 130 and 132 of the body bearing plate portion 60 on either side of the body mounting portion 66 are in firm engagement with the underside 134 of the coupler shank, and specifically its lower wall 52.

As the body mounting portion 66 is driven into and through the slot 54, its crest 74 serves as the lead portion of the body 58, with edge surfaces 112 and 114 camming the walls 80 and 82 toward each other, to bend the walls 80 and 82 to the point that their side walls 90 and 96 are disposed in face to face and thus parallel relation with the coupler shank slot walls 55 and 57. However, the proportioning of the bearing body slot 76 transversely of the body 58 is dimensioned such that the inner edges 140 and 142 of the walls 80 and 82 at the body crest 74 do not engage but remain at least slightly spaced apart.

As the head section 72 of the body mounting portion 66 emerges from slot 54 within the coupler shank hollow center 145, the elastic memory characteristic of the material making up the body 58 effects a returning of the walls 80 and 82 toward their spaced apart relation indicated in FIG. 4, wherein the surfaces 84 and 86 of same were in parallelism. As the upper portions of the walls 80 and 82 return to dispose surfaces 84 and 86 at or near substantial parallelism under the elastic memory action involved, the apex portions 94 and 100 move away from each other to a position that they will be spaced apart a distance that exceeds the width of the slot 54 (dimension D).

The lips 120 and 122 of the coupler shank lower wall 52, in addition to adding structural strength to the wall 52 to make up for that lost by forming the slot 54, also serve as spaced apart stops coacting with the portions of surfaces 90 and 96 that extend inwardly of the lips 120 and 122, and the the body apex portions 94 and 100 they lead to tending to oppose movement of the body mounting portion 66 outwardly of the coupler shank slot 54. Thus, when the coupler shank 26 is in its operative position, the apex portions 94 and 100 of the body 58 overlie the respective lips 120 and 122, and the portions of wall surfaces 90 and 92 that are within the shank center opening 145 diverge from their substantial forced parallelism within the coupler shank slot 54 toward the respective apex portions 94 and 100, whereby the body 58 is anchored in its operating position by the elastic memory action that works in the segments of walls 80 and 82 that project free of slot 54.

The coupler 10 is applied to the car 14 in the normal way, with the slide surface 62 of the bearing body 60 resting on the slide surface 64 of the coupler carrier 44. It is specifically pointed out that the body 58 requires no bonding to the upper shank to hold it in operating position, and as a matter of fact it is preferred that the body 58 not be bonded in place so as to insure that it will flex with the coupler shank when the coupler shank flexes under the impetus of buff and draft impacts.

The polymer material from which the body 58 is formed has a coefficient of sliding or dynamic friction with respect to the coupler carrier surface 64 of about 0.02. However, the contribution to the art provided by this invention involves significantly more than merely providing for a reduced coefficient of friction at the inner face between the body surface 62 and the coupler carrier surface 64.

Specifically, the slide surface 62 of the body 58 effects on the surface 64 a polishing or honing resurfacing action such that, after a period of normal use, the surface 64, instead of wearing, tends to become resurfaced so as to be effectively resistant against further wear.

What appears to happen is that as the coupler shank moves longitudinally of the coupler carrier and from side to side of the center line of draft, the polymer material of the body 58 tends to fill up the pores and level the irregularities in the metal surfacing forming the coupler carrier surface 64, so that the coupler carrier surface 54 becomes partially formed and defined by transferred polymer material from the body 58. Any foreign matter that is caught between the body 58 and the coupler carrier 44 either is moved out of the way or becomes embedded in the body bearing plate portion 60 and is thus positioned to avoid any wearing action on the coupler carrier surface 64.

The body 58 being formed from the indicated dry self lubricating material eliminates the need for applying separate lubricating materials in the area of the coupler carrier, and thus permits the coupler carrier to be free of wet type lubricants that might otherwise be employed for this purpose, and which commonly accumulates foreign matter that aggrevates wear problems. The material employed to form body 58 also resists adherence thereto of foreign matter that thus will not accumulate where it could adversely affect the interface at the bearing body surface 62 and coupler carrier surface 64.

It has also been found that the body surface 62 tends to harden in use, thus increasing its ability to resist wear. This is also true of the polymer material transferred to the coupler carrier surface 64, thus further minimizing wear at these important load resisting surfaces. The resulting resurfacing also means that the coefficient of sliding friction at the surfaces 62 and 64 tends to decrease even below the 0.02 figure as the polymer material builds up on the metal surface 64.

The result is that wear on the coupler shank and coupler carrier in the area of the coupler carrier is eliminated, with the consequent relieving of the railroads from the troublesome maintenance problems caused by wear occasioned by the use of conventional coupler carrier-wear plate arrangements.

In operation, the particular configuration of the bearing body 58, and specifically its mounting portion 66, together with the elastic memory built into same by the nature of the material employed, firmly holds the body 58 in its mounted position in spite of any vibration and stressing that the coupler shank may be subjected to in service. The tendency of the body walls 80 and 82 to return to their positions of FIG. 4 creates a bias acting within the body 58 that, by virtue of the camming action of the angled walls 90 and 96 on the respective coupler shank lip surfaces involved (in particular at their margins 144 and 146), tends to bias the body mounting portion 66 inwardly of slot 54. As indicated, apex portions 94 and 100 being in overlying relation with the lips 120 and 122, and the adjacent portions of surfaces 90 and 92, tend to resist withdrawal of the body mounting portion 66 from slot 54.

A further benefit provided by the invention is that it is now possible for an individual trainman to manually shift couplers equipped with bearing arrangement 50 for proper alignment with the coupler of another car to be coupled with the car in question (a frequent requirement in the field). It is well known that couplers are rather heavy and difficult to move at best, and strained backs are commonly experienced by trainmen attempting to manually move couplers for this purposes. However, couplers equipped in accordance with this invention may be readily shifted to one side or another of the center lien of draft by a trainman using one hand, and without requiring any lifting action at all on the coupler head.

While the invention has been illustrated in association with the type E coupler, it will be apparent that the invention is applicable not only to type F coupler applications, but also type F interlocking coupler applications, in which the coupler shank may be formed with the slot 54 for application of a body 58 thereto for cooperation with the usual resiliently supported coupler carrier.

It will therefore be seen that the invention provides a coupler shank bearing arrangement for replacing the conventional troublesome welded wear plate whereby the coupler shank is equipped with a plain type bearing slide surface for sliding engagement with the coupler carrier in a manner that effectively eliminates wear insofar as the support of the coupler at the coupler shank is concerned.

In addition to the advantages described hereinbefore, the bearing arrangement of this application reduces friction in the back and forth and side to side movements of the coupler, and thus contributes to basic energy conservation in terms of train operation.

Also, the bearing arrangement of the invention provides quieter riding characteristics since metal to metal engagement at the coupler carrier is eliminated and the material from which the body 58 is formed has sound deadening characteristics.

The invention is particularly useful in connection with railroad cars that are to be used in unit trains, which may experience service of up to 130,000 to 150,000 miles per year or more. it is in applications of this sort where wear problems have become particularly critical due to the high mileage conditions of service, and where it is particularly important that all the cars in the train are equipped to avoid the need for frequent shopping of the car.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

We claim:

1. In a railroad car wheeled for riding on track rails and having a body including a center sill projecting from one end of the car and equipped with a coupler striker casting and a coupler mounted on the center sill for swinging movement sidewise of the car and movement longitudinally of the car in response to buff and draft forces acting on the coupler, said coupler including a shank extending through the casting for connection to the sill, with the shank being hollow and defining a lower wall on the underside of same, and a coupler carrier supported by the center sill and having a load support surface on which the coupler shank rests, a coupler shank bearing arrangement interposed between the coupler shank and the coupler carrier, said bearing arrangement comprising:

a bearing structure comprising a body formed from an ultra high molecular weight polymer material of dry self lubricating characteristics, said body being shaped to define:

a lower generally planar bearing plate portion riding on the coupler carrier and an upper mounting portion upstanding from said bearing plate portion of said body, said body mounting portion comprising:

a rectilinear ridge structure defining a base section integral with said body bearing plate portion, and a head section projecting normally of and away from said body bearing plate portion and having a crest extending longitudinally of and substantially paralleling said ridge structure, said bearing plate portion engaging the coupler shank lower wall on one side of said bearing plate portion, said ridge structure between said crest and said base section of said body defining an apex portion extending along either side of said ridge structure adjacent said crest and projecting laterally of said ridge structure and at approximately equal levels above said bearing plate portion, said ridge structure defining a slot extending longitudinally thereof and opening at said crest for the full length of said ridge structure to divide said ridge structure into a plurality of parallel mounting walls extending longitudinally of said ridge structure, said slot extending through the depth of said ridge structure to approximately said base section thereof, said coupler shank lower wall being formed to define a slot extending longitudinally of said shank in which said body ridge structure is received, said coupler shank slot being dimensioned transversely of said coupler shank to substantially complement the transverse dimension of said ridge structure base portion, said ridge structure at the level of said apex portions having a dimension transversely of said ridge structure that is greater than said coupler shank slot transverse dimension, said ridge structure slot being dimensioned transversely of said ridge structure such that said walls are spaced from each other along said crest, said ridge structure apex portions being disposed within the coupler shank, said coupler shank along said slot thereof defining a lip on either side of said slot underlying the respective ridge structure apex portions, whereby said shank lips serve as stops opposing dislodgement of said ridge structure from said shank slot.

2. The coupler shank bearing arrangement set forth in claim 1 wherein:

said ridge structure between said crest and said apex portions on either side thereof defines beveled surfacing for camming said ridge structure walls toward each other on insertion of said body ridge structure through said coupler shank slot, said ridge structure at said head section thereof projecting within said coupler shank sufficiently to be spaced from said coupler shank lips whereby the elastic memory of said material on insertion of said body ridge structure through said shank slot disposes said ridge structure apex portions in overlying relation to the respective coupler shank lips.

3. The coupler shank bearing arrangement set forth in claim 2 wherein:

said body ridge structure slot in the unstressed relation of said ridge structure is of uniform dimension transversely of said ridge structure, with said body slot having a depth within said ridge structure extending substantially below the level of said coupler shank lips.

4. The coupler shank bearing arrangement set forth in claim 3 wherein:

said ridge structure transverse dimension at said crest thereof is defined by the intersection therewith of said beveled surfacing.

5. The coupler shank bearing arrangement set forth in claim 1 wherein:

said body is free of bonded connection to the coupler shank and said body flexes under flexture induced in said coupler shank due to buff and draft forces applied to said coupler.

6. The coupler shank bearing arrangement set forth in claim 1 wherein:

said body bearing plate portion defines a slide surface on the underside of said body that engages the coupler carrier, said body including said slide surface being of one piece construction formed entirely of polyethylene, said body being characterized by having said slide surface effecting during use of said bearing arrangement resurfacing of said coupler carrier load support surface engaged by said slide surface for reforming said coupler carrier surface to have a wear free finish.

7. The coupler shank bearing arrangement set forth in claim 6 wherein:

said slide surface has a coefficient of sliding friction with respect to said coupler carrier surface that is no greater than about 0.02.

8. A bearing structure for replacing railroad car coupler wear plates for supporting the coupler on a coupler carrier, said bearing structure comprising:

a body formed from an ultra high molecular weight polymer material of dry self lubricating characteristics, said body being shaped to define:

a lower generally planar bearing plate portion for riding on the coupler carrier and an upper mounting portion upstanding from said bearing plate portion of said body for application to the coupler shank, said body mounting portion comprising:

a rectilinear ridge structure defining a base section integral with said body bearing plate portion, and a head section projecting normally of and away from said body bearing plate portion and having a crest extending longitudinally of and substantially paralleling said ridge structure, said bearing plate portion being for engaging the coupler shank lower wall on one side of said bearing plate portion, said ridge structure between said crest and said base section of said body defining an apex portion extending along either side of said ridge structure adjacent said crest and projecting laterally of said ridge structure and at approximately equal levels above said bearing plate portion, said ridge structure defining a slot extending longitudinally thereof and opening at said crest for the full length of said ridge structure to divide said ridge structure into a plurality of parallel mounting walls extending longitudinally of said ridge structure, said slot extending through the depth of said ridge structure to approximately said base section thereof, said ridge structure at the level of said apex portions having a dimension transversely of said ridge structure that exceeds said transverse dimension of said ridge structure base portion, said ridge structure at said crest having a dimension transversely of said ridge structure that is less than the transverse dimension of said base section, said ridge structure slot being dimensioned transversely of said ridge structure such that said walls are spaced from each other along said crest, said ridge structure apex portions being spaced apart a dimension transversely of said body that exceeds said base section transverse dimension by a predetermined amount.

9. The bearing structure set forth in claim 8 wherein:

said ridge structure between said crest and said apex portions on either side thereof defines beveled surfacing for camming said ridge structure walls toward each other on insertion of said body ridge structure through a slot formed in the coupler shank, said ridge structure at said head section thereof being proportioned to project within said coupler shank sufficiently to allow the elastic memory of said material on insertion of said body ridge structure through said shank slot to dispose said ridge structure apex portions in removable opposing relation to the respective coupler shank.

10. The bearing structure set forth in claim 9 wherein:

said body ridge structure slot of said ridge structure is of uniform dimension transversely of said ridge structure, with said body slot having a depth within said ridge structure extending substantially to said base section.

11. The bearing structure set forth in claim 10 wherein:

said ridge structure transverse dimension at said crest thereof is defined by the intersection therewith of said beveled surfacing.

* * * * *